US007245089B2

(12) United States Patent
Yang

(10) Patent No.: US 7,245,089 B2
(45) **Date of Patent: *Jul. 17, 2007**

(54) SWITCHING LED DRIVER

(75) Inventor: Ta-Yung Yang, Milpitas, CA (US)

(73) Assignee: System General Corporation, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/265,284

(22) Filed: Nov. 3, 2005

(65) Prior Publication Data

US 2007/0097043 A1 May 3, 2007

(51) Int. Cl.
*G05F 1/00* (2006.01)

(52) U.S. Cl. ..... 315/307; 315/291; 315/224; 315/169.1; 323/282; 323/283; 323/267

(58) Field of Classification Search ..... 315/169.1, 315/169.2, 169.3, 276, 291, 307, 224; 363/13, 363/21.05, 21.09, 21.01, 21.13, 21.15, 21.17, 363/21.18; 345/82, 204, 212, 213; 323/282–284, 323/322; 327/9, 124, 126, 148, 166
See application file for complete search history.

(56) References Cited

U.S. PATENT DOCUMENTS 5,642,130 A * 6/1997 Browne ..... 345/111
6,721,192 B1 * 4/2004 Yang et al. ..... 363/21.18
6,798,152 B2 * 9/2004 Rooke et al. ..... 315/209 R
6,801,028 B2 * 10/2004 Kernahan et al. ..... 323/283
6,836,415 B1 * 12/2004 Yang et al. ..... 363/21.01
6,888,383 B1 * 5/2005 Fairbanks ..... 327/124
7,116,294 B2 * 10/2006 Stopa ..... 345/82
2005/0151708 A1 * 7/2005 Farmer et al. ..... 345/82
2006/0214603 A1 * 9/2006 Oh et al. ..... 315/246

OTHER PUBLICATIONS

U.S. Appl. No. 11/268,536 by Yang, filed Nov. 8, 2005.*

* cited by examiner

*Primary Examiner*—Haissa Philogene
(74) *Attorney, Agent, or Firm*—Rosenberg, Klein & Lee

(57) ABSTRACT

The present invention provides a LED driver for controlling the brightness of the LED. An inductor and a switch are connected in series with the LED for controlling the current of the LED. A diode is coupled in parallel to the inductor for freewheeling the energy of the inductor through the LED. A control circuit is developed to generate a control signal for switching the switch in response a reflected signal of inductor and the LED current. The LED current is further adjusted in response to the reflected signal. The value of the reflected signal is correlated to the LED temperature. Therefore the LED current can be programmed in accordance with the LED temperature.

10 Claims, 5 Drawing Sheets

SWITCHING LED DRIVER

BACKGROUND OF THE INVENTION

1. Field of Invention

The present invention relates to a LED (light emission diode) driver, and more particularly to a control circuit for controlling the LED.

2. Description of Related Art

The LED driver is utilized to control the brightness of LED in accordance with its characteristic. The LED driver is utilized to control the current that flows through the LED. Therefore, a higher current will increase intensity of the brightness, but decrease the life of the LED. FIG. 1 shows a traditional circuit of the LED driver. The voltage source 10 is adjusted to provide a current $I_{LED}$ to the LEDs 20~25 through a resistor 15. The current $I_{LED}$ can be shown as equation (1):

$$I_{LED} = \frac{V - V_{F20} - V_{F21} - \ldots - V_{F25}}{R_{15}} \quad (1)$$

wherein the $V_{F20}$~$V_{F25}$ are the forward voltages of the LEDs 20~25 respectively.

The drawback of the LED driver shown in FIG. 1 is the variation of the current $I_{LED}$. The current $I_{LED}$ is changed in response to the change of the forward voltages of $V_{F20}$~$V_{F25}$. The forward voltages of $V_{F20}$~$V_{F25}$ are not a constant due to the variation of the production and operating temperature. Moreover, a second drawback of the LED driver is the power loss on the resistor 15 shown in FIG. 1.

FIG. 2 shows another traditional approach of the LED driver. A current source 35 is connected in series with the LEDs 20~25 to provide a constant current to the LEDs 20~25. However, the disadvantage of this circuit is the power loss of the current source 35, particularly as the voltage source 30 is high and the LED voltage drop of $V_{F20}$~$V_{F25}$ are low. Besides, the chromaticity and the luminosity of the LED relate to the temperature of the LED. In order to keep the chromaticity and/or the luminosity of the LED as a constant, the current of the LED should be adjusted in response to the change of temperature. The objective of the present invention is to provide a LED driver to achieve higher efficiency. The second objective of the present invention is to develop a LED driver having the temperature compensation.

SUMMARY OF THE INVENTION

The present invention provides a switching LED driver to control the brightness of a LED. The LED driver comprises an energy-transferred element such as a transformer or an inductor having a first winding connected in series with the LED. Further, a switch is connected in series with the LED and the first winding of the inductor for controlling a LED current. A control circuit is coupled to a second winding of the inductor to generate a control signal in response to a reflected signal of the inductor and the LED current. A first resistor is connected in series with the switch to sense the LED current and generate a LED current signal coupled to the control circuit. A diode is coupled in parallel to the LED and the inductor is used for discharging the energy of the inductor through the LED. The control signal is utilized to control the switch and the LED current. Therefore the switch is turned off once the LED current is higher than a first threshold, and the switch is turned on after a programmable delay time once the energy of the inductor is fully discharged. Besides, the first threshold is varied in response to the reflected signal of the inductor. The value of the reflected signal shows the LED forward voltage that is correlated to the LED temperature. Therefore the LED current can be programmed to compensate the chromaticity and the luminosity variations in accordance with the LED temperature.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention. In the drawings, FIG. 1 shows a traditional LED driver;

DESCRIPTION OF THE PREFERRED EMBODIMENT

Figure 1:
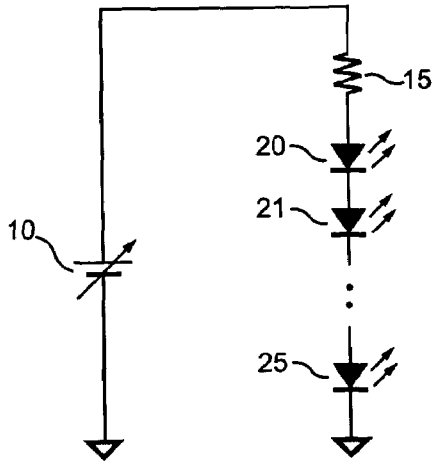
FIG. 1 (Prior Art)
Figure 2:
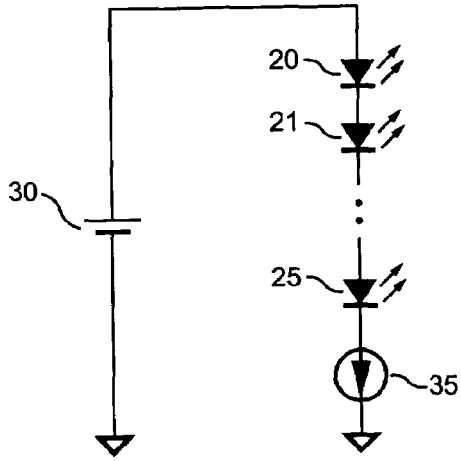
FIG. 2 (Prior Art)
FIG. 2 shows another traditional LED driver.
Figure 3:
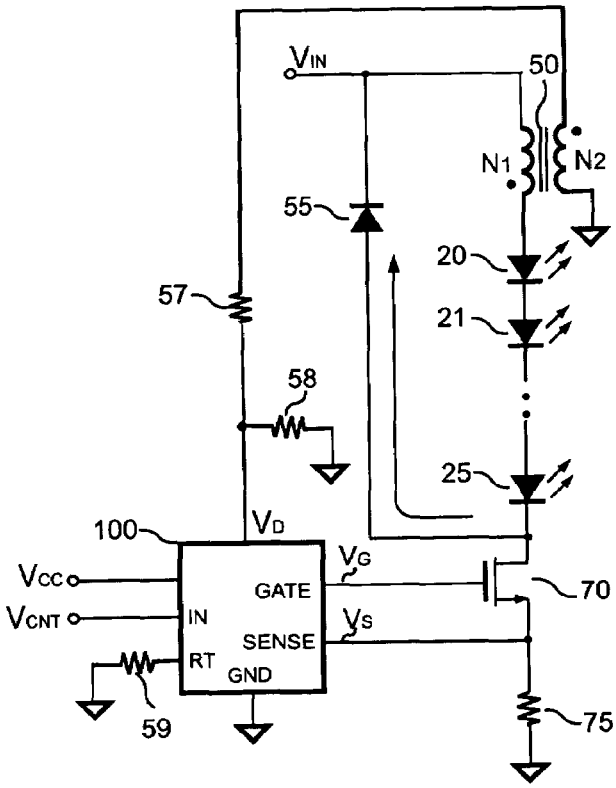
FIG. 3 shows a switching LED driver in accordance with present invention.

FIG. 3 shows a switching LED driver in accordance with present invention, in which a first winding N1 of a inductor 50 is coupled in series with the LEDs 20~25. The first winding N1 of the inductor 50 includes an inductance. Further, a switch 70 is connected in series with the LEDs 20~25 and the first winding N1 of the inductor 50 for controlling the LED current. The LED current is further converted to a current signal $V_S$ coupled to a control circuit 100 via a resistor 75. The control circuit 100 is further coupled to a second winding N2 of the inductor 50 to receive the reflected signal of the inductor 50 through resistors 57 and 58. A diode 55 is coupled in parallel to the LEDs 20~25 and the inductor 50. Once the switch 70 is turned off, the energy of the inductor 50 is discharged through the LEDs 20~25 and the diode 55. Meanwhile the forward voltage of the LEDs 20~25 is reflected to the secondary winding N2 of the inductor 50. Therefore the reflected signal of the inductor 50 shows the forward voltage of the LEDs 20~25. More, the forward voltage of the LED decreases in proportion to the increase of the LED temperature. Accordingly the reflected signal of the inductor 50 can show the variation of the LED temperature. Besides, the reflected signal of the inductor 50 will fall to zero when the energy of the inductor 50 is fully discharged. For limiting the LED current, the switch 70 is turned off once the LED current is higher than a first threshold $V_R$. The maximum LED current can be expressed as equation (2):

$$I_{LED(MAX)} = \frac{V_{IN} - V_{F20} - \ldots - V_{F25}}{L_{50}} \quad (2)$$

where the $L_{50}$ is the inductance of the inductor 50; $T_{ON}$ is the on-time of the switch 70.

Figure 4A:
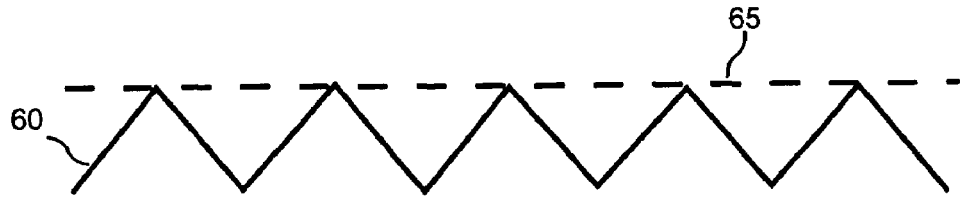
FIGS. 4A and 4B shows LED current waveforms in accordance with present invention.
Figure 4B:
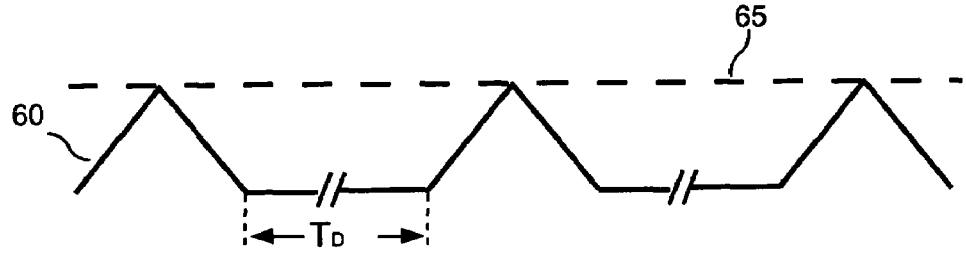

By detecting the reflected signal of the inductor 50, the switch 70 is turned on after a delay time $T_D$ once the energy of the inductor 50 is fully discharged. FIGS. 4A and 4B show a LED current waveform 60, in which the maximum value 65 of the first threshold $V_R$ limits the peak value of the LED current. The switch 70 is turned on to enable the LED current in response to the fully discharge of the inductor 50. The LED current is thus controlled as a triangle waveform. The maximum value 65 of the first threshold $V_R$ determines the average value of the LED current. Consequently the average value of the LED current is controlled as a constant despite the inductance variation of the inductor 50. Furthermore, the delay time $T_D$ is programmed to control value of the LED current and the brightness of the LEDs 20 to 25.

The control circuit 100 is utilized to generate a control signal $V_G$ to control the switch 70 and the LED current in response to the LED current and the reflected signal of the inductor 50. In order to keep the chromaticity and the luminosity of the LED as a constant, the LED current should be adjusted referring to the LED temperature. According to present invention, the first threshold $V_R$ and the reflected signal of the inductor 50 are correlated to the LED current and the LED temperature respectively. The first threshold $V_R$ is controlled and varied in response to the reflected signal of the inductor 50 for the chromaticity and the luminosity compensation. Furthermore, for adapting various LEDs, a resistor 59 is coupled to the control circuit 100 to determine the slope of the adjustment. The slope stands for the change of the first threshold $V_R$' versus 'the change of the reflected signal of the inductor 50'.

Figure 5:
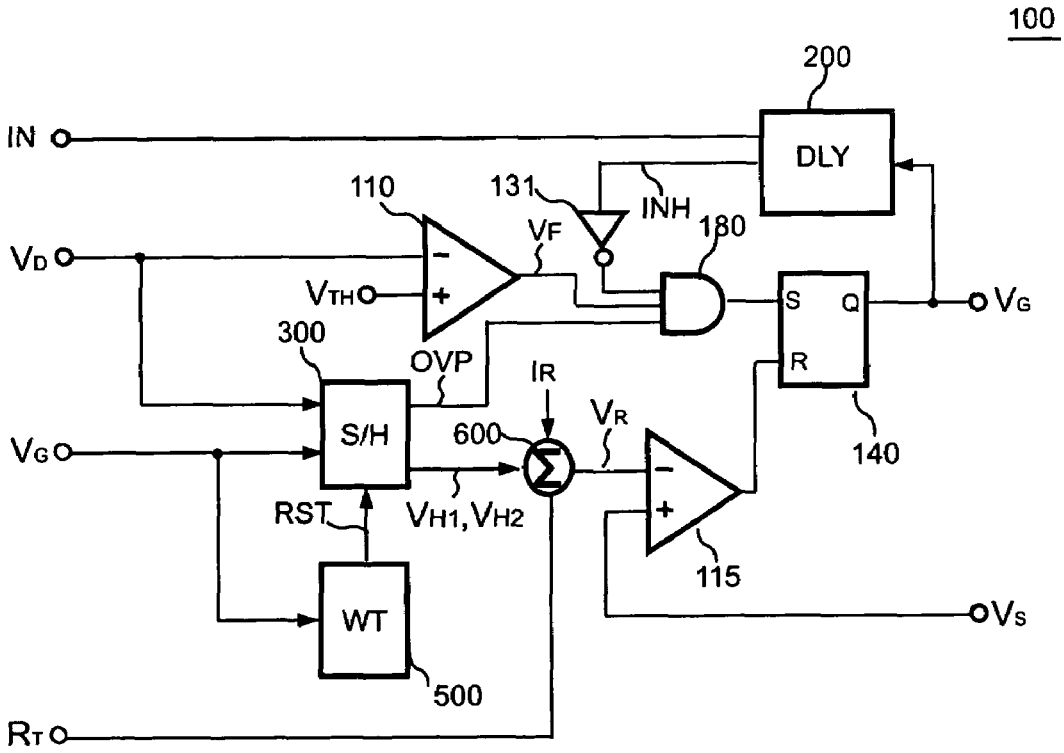
FIG. 5 shows a control circuit of the switching LED driver in accordance with present invention.

FIG. 5 shows a circuit schematic of the control circuit 100. The first threshold $V_R$ is coupled to turn off the control signal $V_G$ once the current signal $V_S$ is higher than the first threshold $V_R$. A second threshold $V_{TH}$ is coupled to turn on the control signal $V_G$ once an attenuated reflected signal $V_D$ is lower than the second threshold $V_{TH}$. Through the resistors 57 and 58, the reflected signal $V_D$ is produced by the reflected signal of the inductor 50. A first control circuit including an AND gate 180, an inverter 131 and a flip-flop 140 generate the control signal $V_G$ in response to a delay signal INH and an enable signal $V_F$. The output of the AND gate 180 is connected to enable the flip-flop 140. The control signal $V_G$ is generated at the output of the flip-flop 140. A second control circuit 115 is applied to disable the control signal $V_G$ once the current signal $V_S$ is higher than the first threshold $V_R$. The output of the second control circuit 115 is connected to disable the flip-flop 140. A delay circuit 200 generates the delay signal INH having the delay time $T_D$ in response to the off-state of the control signal $V_G$. The delay signal INH is connected to the input of the AND gate 180 through the inverter 131. The control signal $V_G$ is disabled during the period of the delay time $T_D$. A sample circuit 300 is coupled to sample the reflected signal $V_D$ and generate a first-sampled signal $V_{H1}$, a second-sampled signal $V_{H2}$ and an over-voltage signal OVP. The over-voltage signal OVP is further connected to the second input of the AND gate 118 to disable the control signal $V_G$ and protect the LED from an over-voltage supply. A constant current $I_R$ is supplied to a current adjust circuit 600 to generate the first threshold $V_R$. The first-sampled signal $V_{H1}$ and the second-sampled signal $V_{H2}$ are connected to the current adjust circuit 600 to program the value of the first threshold $V_R$. A watchdog timer 500 is utilized to generate a reset signal RST in response to the control signal $V_G$ and the power source $V_{CC}$. The reset signal RST is connected to reset the sample circuit 300. A comparison circuit 110 is applied to produce the enable signal $V_F$ once the reflected signal $V_D$ is lower than a second threshold $V_{TH}$. The enable signal $V_F$ is connected to the third input of the AND gate 180 for enabling the control signal $V_G$.

Figure 6:
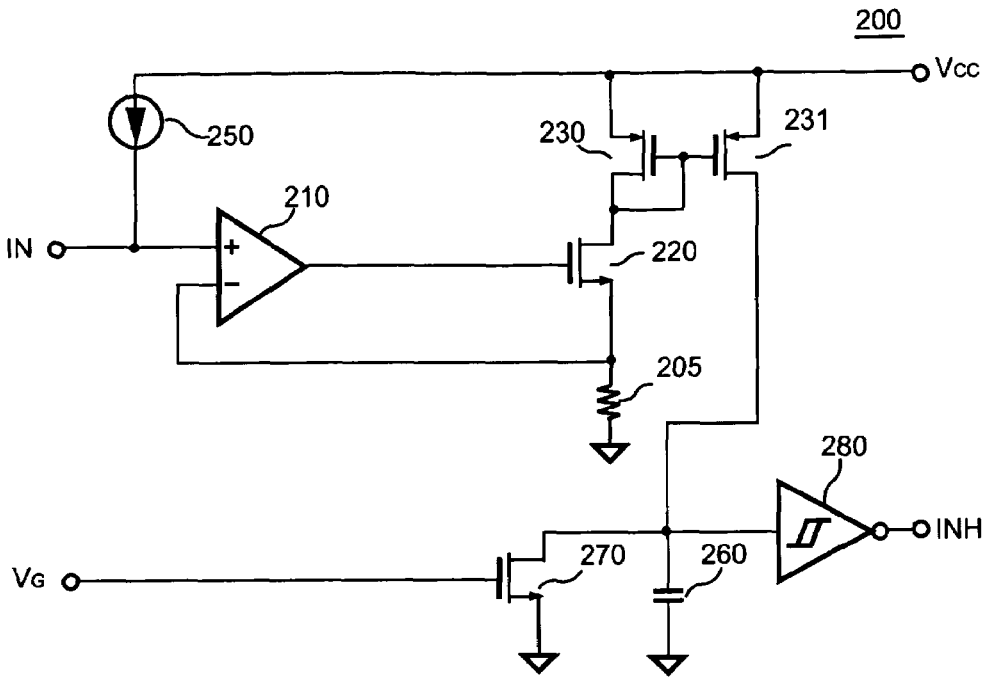
FIG. 6 shows a delay circuit that control the brightness of LED in accordance with present invention.

FIG. 6 shows the delay circuit 200 that controls the brightness of LED. A constant current source 250 is connected to an input terminal IN of the control circuit 100. The input terminal IN is developed to program the brightness of the LED. A resistor connected from the input terminal IN to ground and/or a control voltage $V_{CNT}$ connected to the input terminal IN will program the value of the time delay $T_D$. A operational amplifier 210, a resistor 205, transistors 220, 230 and 231 form a voltage-to-current converter for generating a charge current at transistor 231 referring to the voltage at the input terminal IN. A transistor 270 is connected to discharge a capacitor 260. The input of the transistor 270 is connected to the control signal $V_G$. The charge current is coupled to charge the capacitor 260 in response to the off-state of the control signal $V_G$. The input of in inverter 280 is connected to the capacitor 260. The output of the inverter 280 generates the delay signal INH.

Figure 7:
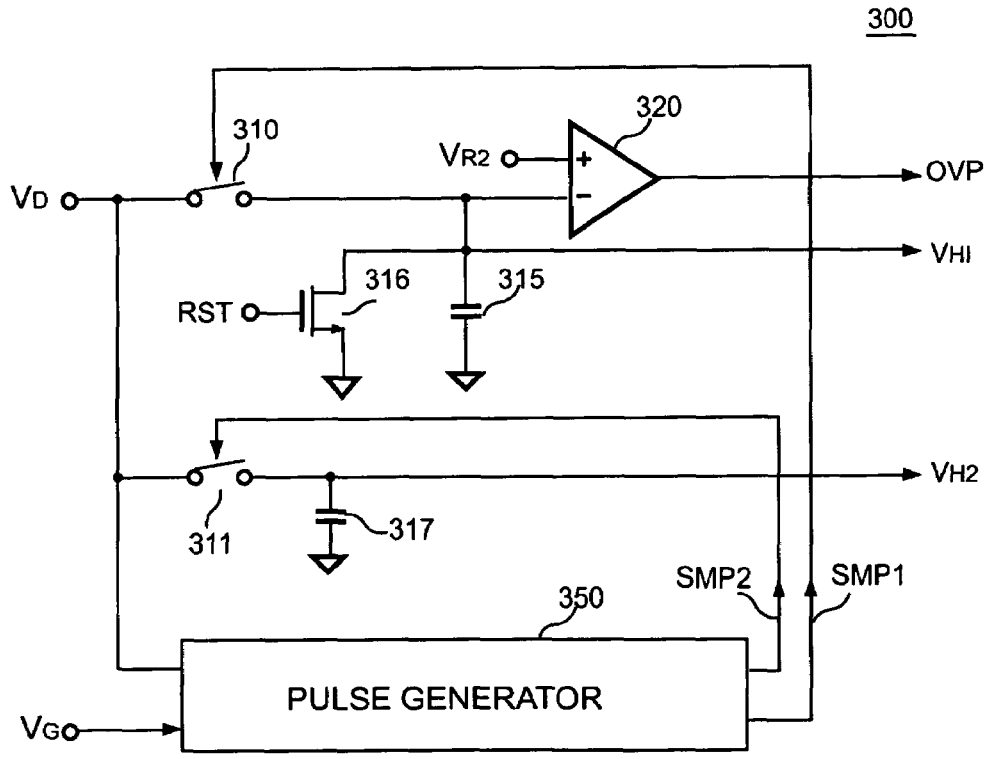
FIG. 7 shows a sample circuit of the control circuit in accordance with present invention.
Figure 8:
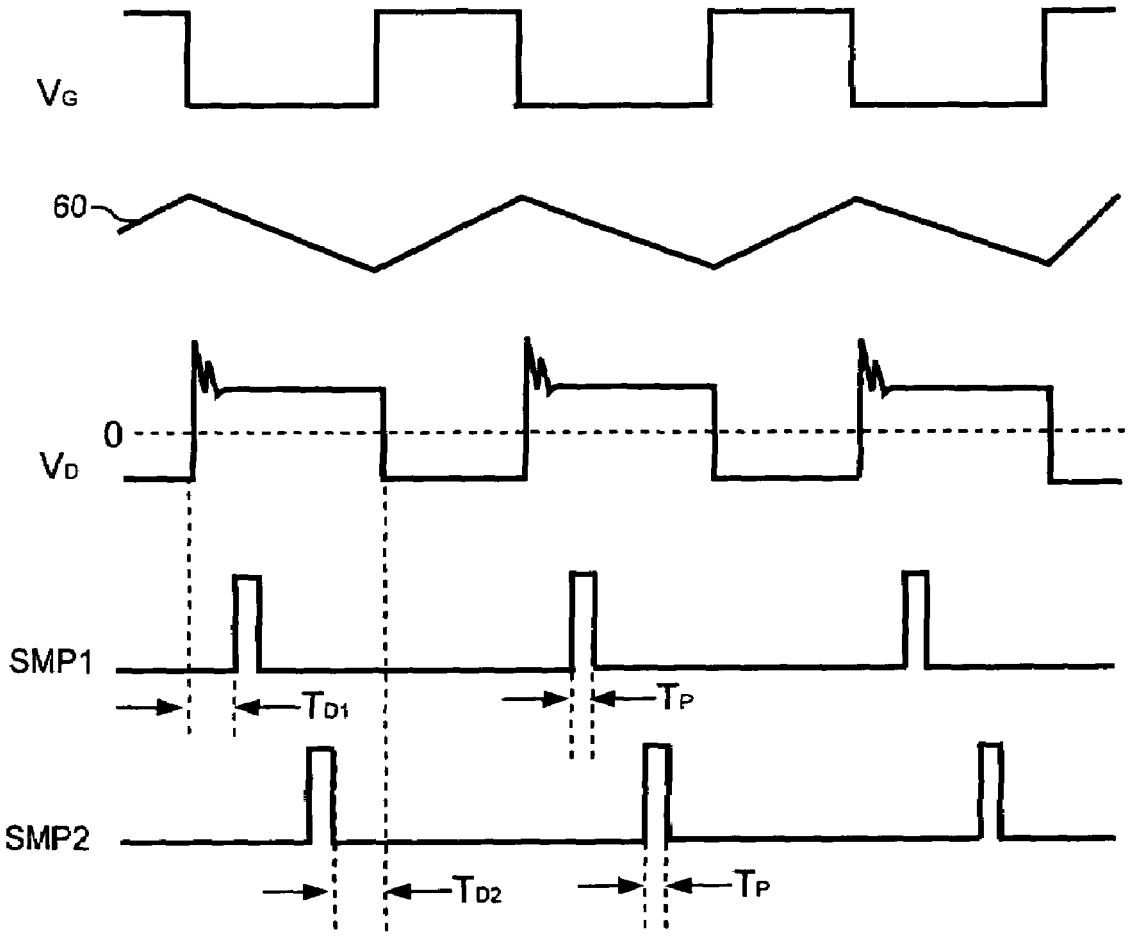
FIG. 8 shows signal waveforms of the control circuit in accordance with present invention.
Figure 9:
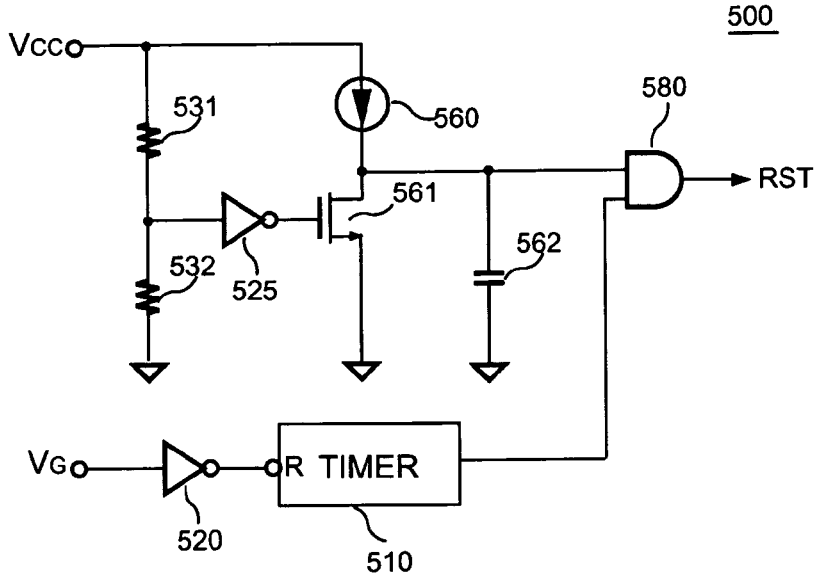
FIG. 9 shows the circuit schematic of a watchdog timer of the control circuit.

FIG. 7 shows the sample circuit 300 of the control circuit 100. A pulse generator 350 generates a first pulse SMP1 and a second pulse SMP2 in response to the off-state of the control signal $V_G$ and the reflected signal $V_D$. FIG. 8 shows the signal waveforms, in which the first pulse SMP1 is produced after the control signal is off. A delay time $T_{D1}$ ensures that the reflected signal $V_D$ is stable before enabling the first pulse SMP1. A delay time $T_{D2}$ ensures that the second pulse SMP2 is produced before the reflected signal $V_D$ falling to zero. The first pulse SMP1 and the second pulse SMP2 are coupled to control the on/off-state of a switch 310 and a switch 311. The switch 310 and the switch 311 are coupled to sample the reflected signal $V_D$ and generate the first-sampled signal $V_{H1}$ and the second-sampled signal $V_{H2}$ on capacitors 315 and 317 respectively. Therefore the first-sampled signal $V_{H1}$ and the second-sampled signal $V_{H2}$ represent a first forward voltage of LED and a second forward voltage of LED in response to a first LED current and a second LED current respectively. A transistor 316 coupled to the reset signal RST is connected to discharge the capacitor 315. A comparison circuit 320 is connected to the capacitor 315 to generate the over-voltage signal OVP once the first-sampled signal $V_{H1}$ is higher than a threshold voltage $V_{R2}$. FIG. 9 shows a schematic diagram of the watchdog timer 500. A reset circuit includes a capacitor 562, a transistor 561, a current source 560, an inverter 525 and resistors 531, 532 to generate a power-on reset signal in response to the on-state of the power source $V_{CC}$. Through an inverter 530, a timer 510 is connected to the control signal $V_G$ to generate a time-out signal. The time-out signal is generated when the control signal $V_G$ is off over a time-out period. An AND gate 580 is connected to the time-out signal and the power-on reset signal to generate the reset signal RST.

Figure 10:
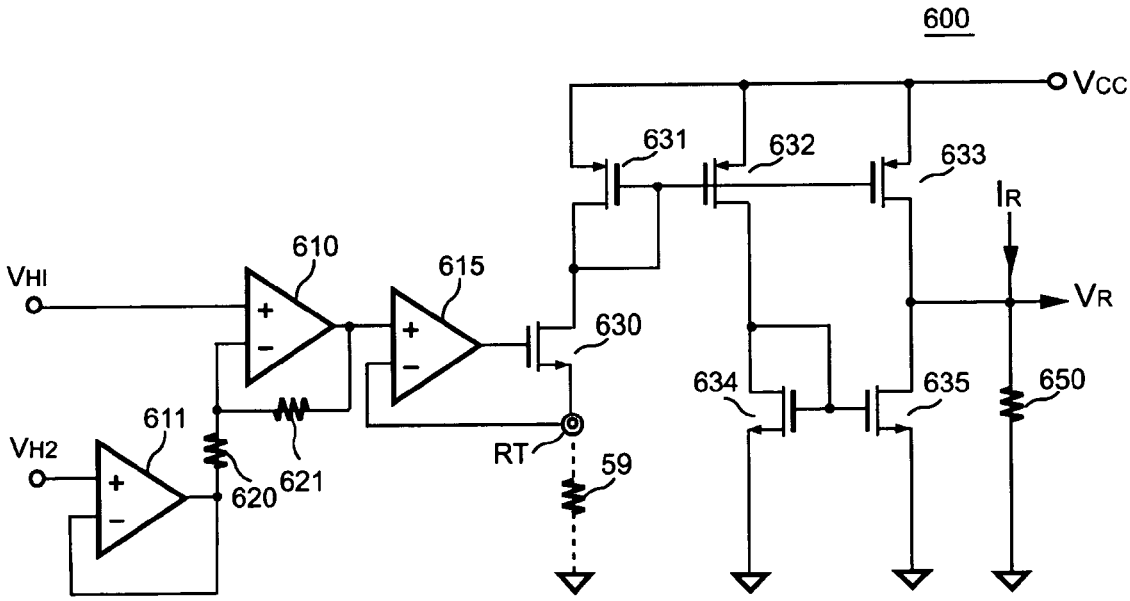
FIG. 10 shows a current adjust circuit in accordance with present invention.

The current adjust circuit 600 is shown in FIG. 10. Operational amplifiers 610, 611 and resistors 620, 621 develop a differential circuit. The first-sampled signal $V_{H1}$ and the second-sampled signal $V_{H2}$ are connected to the differential circuit. The differential value of the first-sampled signal $V_{H1}$ and the second-sampled signal $V_{H2}$ is produced at the output of the operational amplifier 610. The output of the operational amplifier 610 is further coupled to the input of an operational amplifier 615. The operational amplifier 615, transistors 630–635 and the resistor 50 form another voltage-to-current converter for generating the currents $I_{633}$ and $I_{635}$ in proportion to the resistance of the resistor 59 and the differential value of the first-sampled signal $V_{H1}$ and the second-sampled signal $V_{H2}$. A resistor 650 associated with the constant current $I_R$ generates the first threshold $V_R$, and the current $I_{633}$ and the current $I_{635}$ are connected to the resistor 650 for adjusting the first threshold VR. The first-sampled signal $V_{H1}$ and the second-sampled signal $V_{H2}$ as shown in equation (3) and equation (4) respectively correspond to the first forward voltage $V_1$ and the second forward voltage $V_2$:

$$V_{H1} = \frac{R_{58}}{R_{57} + R_{58}} \times \frac{N_{T2}}{N_{T1}} \times V1 \tag{3}$$

$$V_{H2} = \frac{R_{58}}{R_{57} + R_{58}} \times \frac{N_{T2}}{N_{T1}} \times V2 \tag{4}$$

where $N_{T1}$ and $N_{T2}$ are the turn numbers of the first winding and the second winding respectively; $R_{57}$ and $R_{58}$ are resistance of resistors 57 and 58.

The first forward voltage $V_1$ and the second forward voltage $V_2$ correspond to a first LED current $I_1$ as shown in equation (5) and a second LED current $I_2$ as shown in equation (6). The currents $I_1$ and $I_2$ are given by, $$I_1 = I_0 \times e^{V1/VT} \tag{5}$$

$$I_2 = I_0 \times e^{V2/VT} \tag{6}$$

$$\text{where } VT = \frac{k \times \text{Temp}}{q} \tag{7}$$

$$\text{Temp} = \frac{q}{k} \times \frac{V_1 - V_2}{\ln\left(\frac{I_1}{I_2}\right)} \tag{8}$$

where k is the Boltzmann's constant; q is the charge on an electron; and $T_{emp}$ is the absolute temperature.

Foregoing equations show that the LED temperature can be accurately detected from the reflected signal $V_D$. The LED temperature is further used for programming the LED current and compensating the chromaticity and the luminosity of the LED.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A LED driver, comprising, a inductor having a first winding connected in series with a LED;

a switch, connected in series with the LED and the first winding of the inductor for controlling a LED current;

a control circuit, coupled to a second winding of the inductor for generating a control signal in response to a reflected signal of the inductor and the LED current; and a diode, coupled in parallel to the LED and the inductor for discharging the energy of the inductor through the LED;

a first resistor, connected in series with the switch for sensing the LED current and generating a LED current signal coupled to the control circuit; and a second resistor, connected to the control circuit for determining a slope of the adjustment, in which the slope represents the change of a first threshold versus the change of the reflected signal of the inductor;

wherein the control signal controls the switch and the LED current, and the switch is turned off once the LED current is higher than the first threshold; the switch is turned on after a period of a programmable delay time once the energy of the inductor is fully discharged.

2. The LED driver as claimed in claim 1, wherein the first threshold is varied in response to the reflected signal of the inductor.

3. The LED driver as claimed in claim 1, wherein the control circuit comprises:

a first control circuit, for enabling the control signal in response to a delay signal and an enable signal;

a second control circuit, for disabling the control signal once the LED current signal is higher than the first threshold;

a delay circuit, for generating the delay signal having the programmable delay time in response to the off-state of the control signal, in which the control signal is disabled during the period of the programmable delay time;

a sample circuit, coupled to the second winding of the inductor for generating a first-sampled signal and a second-sampled signal in response to the reflected signal; and a comparison circuit, for producing the enable signal once the reflected signal is lower than a second threshold;

wherein the first-sampled signal and the second-sampled signal are used to adjust the values of the first threshold.

4. The LED driver as claimed in claim 3, wherein the first-sampled signal and the second-sampled signal represent a first forward voltage of the LED and a second forward voltage of the LED in response to a first LED current and a second LED current respectively.

5. The LED driver as claimed in claim 1, wherein the inductor is a transformer.

6. A LED driver, comprising:

an energy-transferred element connected in series with a LED;

a switch connected in series with the LED and the energy-transferred element for controlling a LED current;

a control circuit, coupled to the energy-transferred element for generating a control signal in response to a reflected signal of the energy-transferred element and the LED current; and a diode, coupled in parallel to the LED and the energy-transferred element for discharging the energy of the energy-transferred element through the LED;

wherein the control signal controls the switch and the LED current, and the switch is turned off once the LED current is higher than a first threshold.

7. The LED driver as claimed in claim 6, wherein the first threshold is varied in response to the reflected signal of the energy-transferred element.

8. The LED driver as claimed in claim 6, further comprising:

a first resistor, connected in series with the switch for sensing the LED current and generating a LED current signal coupled to the control circuit; and a second resistor, connected to the control circuit for determining a slope of the adjustment, in which the slope represents the change of the first threshold versus the change of the reflected signal of the energy-transferred element.

9. The LED driver as claimed in claim 6, wherein the control circuit comprises:

a first control circuit, for enabling the control signal in response to a delay signal and an enable signal;

a second control circuit, for disabling the control signal once the LED current signal is higher than the first threshold;

a delay circuit, for generating the delay signal having the programmable delay time in response to the off-state of the control signal, and the control signal is disabled during the period of the programmable delay time;

a sample circuit, coupled to the energy-transferred element for generating a first-sampled signal and a second-sampled signal in response to the reflected signal; and a comparison circuit, for producing the enable signal once the reflected signal is lower than a second threshold;

wherein the first-sampled signal and the second-sampled signal are used to adjust the values of the first threshold.

10. The LED driver as claimed in claim 9, wherein the first-sampled signal and the second-sampled signal represent a first forward voltage of the LED and a second forward voltage of the LED in response to a first LED current and a second LED current respectively.

* * * * *